US006837704B1

(12) United States Patent
Hsu

(10) Patent No.: US 6,837,704 B1
(45) Date of Patent: Jan. 4, 2005

(54) ELECTRONIC PILOT IGNITION WITH SAFETY SWITCH

(76) Inventor: Huang-Hsi Hsu, 8F. No. 14, Lane 252, Chungshan N. Rd., Sec. 6, Taipei (TW)

( * ) Notice: Subject to any disclaimer, the term of this patent is extended or adjusted under 35 U.S.C. 154(b) by 0 days.

(21) Appl. No.: 10/671,830

(22) Filed: Sep. 29, 2003

(51) Int. Cl.[7] ..... F23D 11/36
(52) U.S. Cl. ..... 431/153; 431/255
(58) Field of Search ..... 431/153, 255, 431/256

(56) References Cited

U.S. PATENT DOCUMENTS 5,997,282 A * 12/1999 Man ..... 431/153
6,086,358 A * 7/2000 Potskhishvili et al. ..... 431/153
6,296,476 B1 * 10/2001 Tsai ..... 431/153
6,318,992 B1 * 11/2001 Sung ..... 431/153
6,439,879 B1 * 8/2002 Hsu ..... 431/153
6,447,287 B1 * 9/2002 Hsu ..... 431/153
6,488,493 B2 * 12/2002 Sung ..... 431/153
6,565,354 B2 * 5/2003 Liang ..... 431/153

* cited by examiner

*Primary Examiner*—Alfred Basichas
(74) *Attorney, Agent, or Firm*—Bacon & Thomas PLLC

(57) ABSTRACT

The present invention is to provide an electronic pilot ignition with safety switch comprising a hollow body, a safety switch installed freely on the center of the hollow body, a pedestal on the safety switch and a brake bar inside a slide slot of the pedestal to move right or left in the slide slot, wherein the top of the brake bar exposes to the pedestal and the bottom of the brake bar stretches horizontally to an indentation slot of the hollow body to have the indentation slot block the brake bar, so that the safety switch can not be moved forward. A brake component is installed freely in an open slot of the pedestal near the brake bar, the brake component can be moved forward or backward inside the open slot and wedges to one of the open slot of the brake bar.

6 Claims, 7 Drawing Sheets

ELECTRONIC PILOT IGNITION WITH SAFETY SWITCH

BACKGROUND OF THE INVENTION

I. Field of the Invention

This invention relates generally to an electronic pilot ignition and, more specifically, to an electronic pilot ignition that users have to press the safety switch first to start the electronic pilot for flame to prevent children or others from starting the fire accidentally.

II. Description of the Prior Art

Heretofore, it is known that an ignition (as shown in FIG. 1 and FIG. 2) has a rectangular hollow shell handle (11), a tube (12) stretches out from one side of the hollow shell handle (11), a gas tank (13) and an electronic pilot (14) are inside the hollow shell handle (11); a gas outlet (131) is on top of the gas tank (13), a soft tube (133) connects to the gas outlet (131), the other side of the soft tube (133) stretches out to the top of the tube (12) and connects to the ignition area (not shown in FIG) of the ignition (1); a pulling board (135) is on the proper location of the gas outlet (131) of the gas tank (13), a starter (141) is on the bottom of the electronic pilot (14), the end of the starter (141) stretches down and connects to the free end of the pulling board (135), the electronic pilot (14) connects to the ignition (1) through a wire (143) and connects to the inner brim of the tube (12) with another wire (not shown in FIG) to form a ignition loop.

An open hole (not shown in FIG) is on the free end of the handle (11) corresponding to the starter (141) and pulling board (135), an ignition switch (15) is installed freely on the open to let the ignition switch (15) move forward or backward on the handle (11), an ignition board (151) is beneath the ignition switch (15), the end of the ignition switch (15) stretches down and connects to the free end of the starter (141) and the pulling board (135), when the ignition switch is moved forward, the ignition board (151) can push the starter (141) and the pulling board (135) together, the pulling board (135) pulls the gas outlet (131) of the gas tank (13), the gas inside of the gas tank (13) flows through the soft tube (133) and reaches the ignition area of the ignition (1), at the same time to have the electronic pilot (14) generate a pilot fire on the ignition area of the ignition (1) and make fire by the gas of the gas tank (13) and the pilot fire generated by the electronic pilot (14).

In order to prevent users from ignite fire accidentally, a horizontal open (111) is on back of the handle (11) that is corresponding to the ignition board (151), a safety switch (16) is installed freely on the horizontal open (111), a blocking bar (161) is on the safety switch (16), when the safety switch is on the location of the ignition switch (15), the ignition switch (15) can not be pushed forward to ignite, when the safety switch (16) is off the location of the ignition switch (15), the ignition switch (15) is moved forward to make fire, the mechanism can prevent users from push the ignition switch (15) for accident.

However when the ignition (1) is played by children, the safety switch (16) that exposes external to the shell body is detected easily, the safety switch (16) can be moved away from the location that block the ignition switch (15) to push the ignition switch (15), that might cause fire and result accident. The safety switch (16) of the ignition (1) cannot really effectively prevent children cause fire and accident.

SUMMARY OF THE INVENTION

It is therefore a primary object of the invention to provide an electronic pilot ignition with safety switch to prevent accident by children or mistakenly fire that cause danger.

In order to achieve the objective set forth, a an electronic pilot ignition with safety switch in accordance with the present invention comprises a hollow body graspable by users, a safety switch is installed freely on the center of the hollow body, the safety switch can be moved forward or backward inside the hollow body; a pedestal is on the safety switch, a brake bar is inside a slide slot of the pedestal to move right or left in the slide slot; the top of the brake bar exposes to the pedestal, the brake bar bottom stretches horizontally to an indentation slot of the hollow body to have the indentation slot block the brake bar, so the safety switch can not be moved forward. A brake component is installed freely in an open slot of the pedestal near the brake bar, the brake component can move inside the open slot forward or backward; one end of the brake component wedges to one of the open slot of the brake bar. When start fire, users have to push the brake component away from the corresponding the location of the open slot, then push the brake bar away from the location of the corresponding indentation slot, the safety switch then can be pushed forward for fire, the mechanism can prevent the safety switch from accidentally pushing forward that might cause accident.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
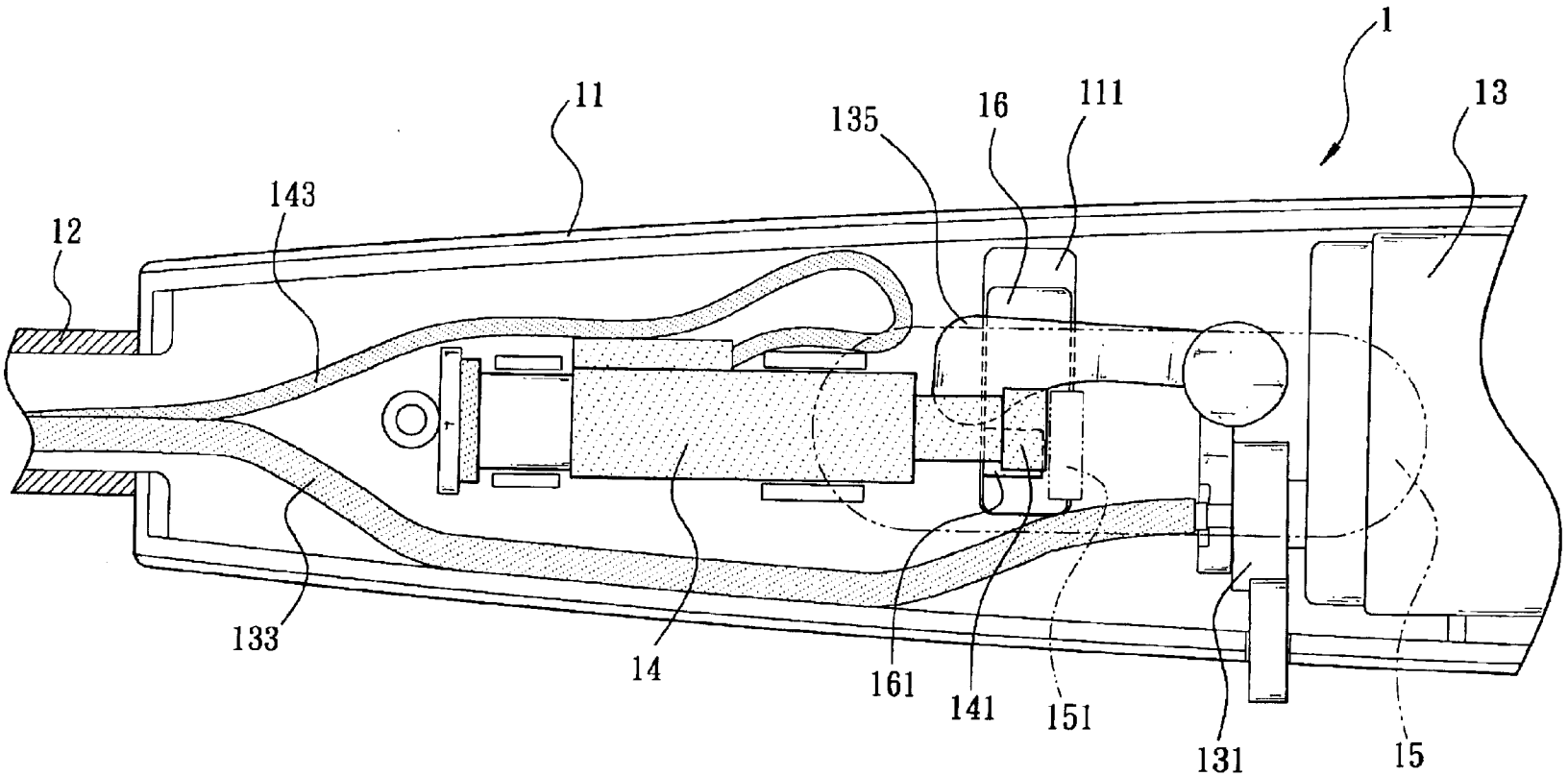
FIG. 1 (Prior Art)
FIG. 1 is a cross-sectional view of the prior art.
Figure 2:
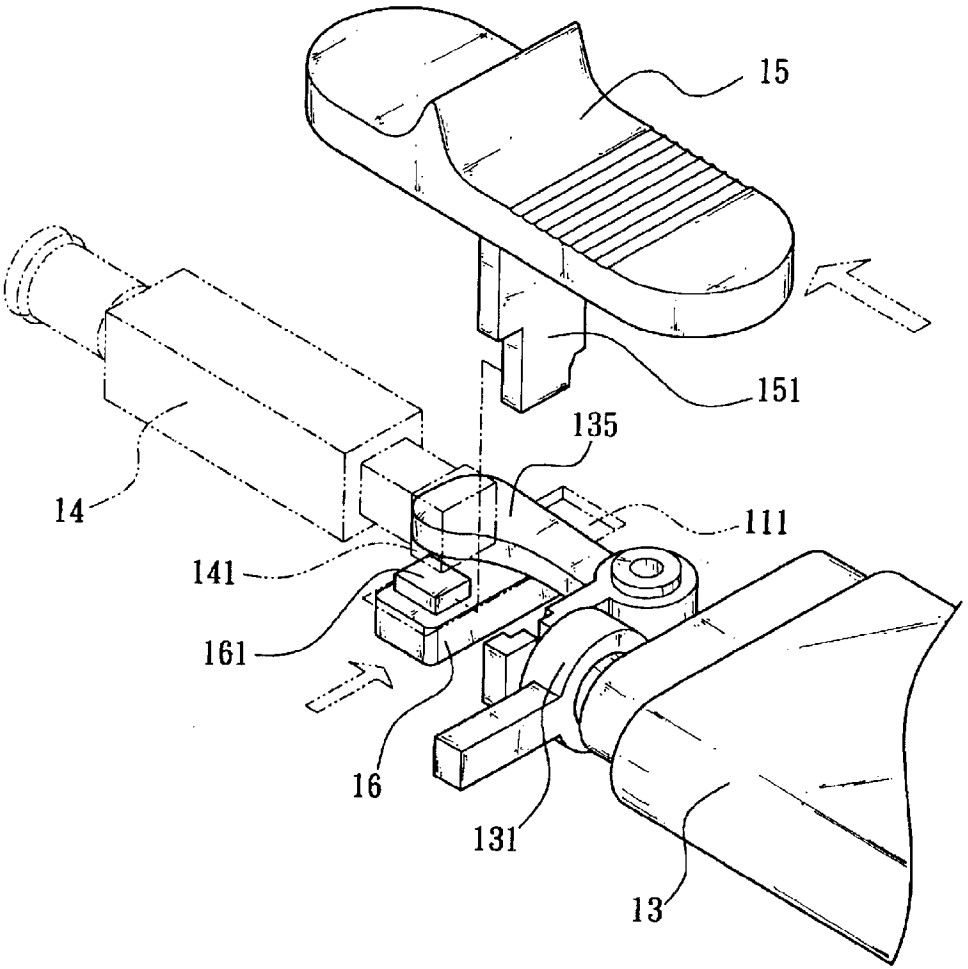
FIG. 2 (Prior Art)
FIG. 2 is a perspective view of the prior art.
Figure 3:
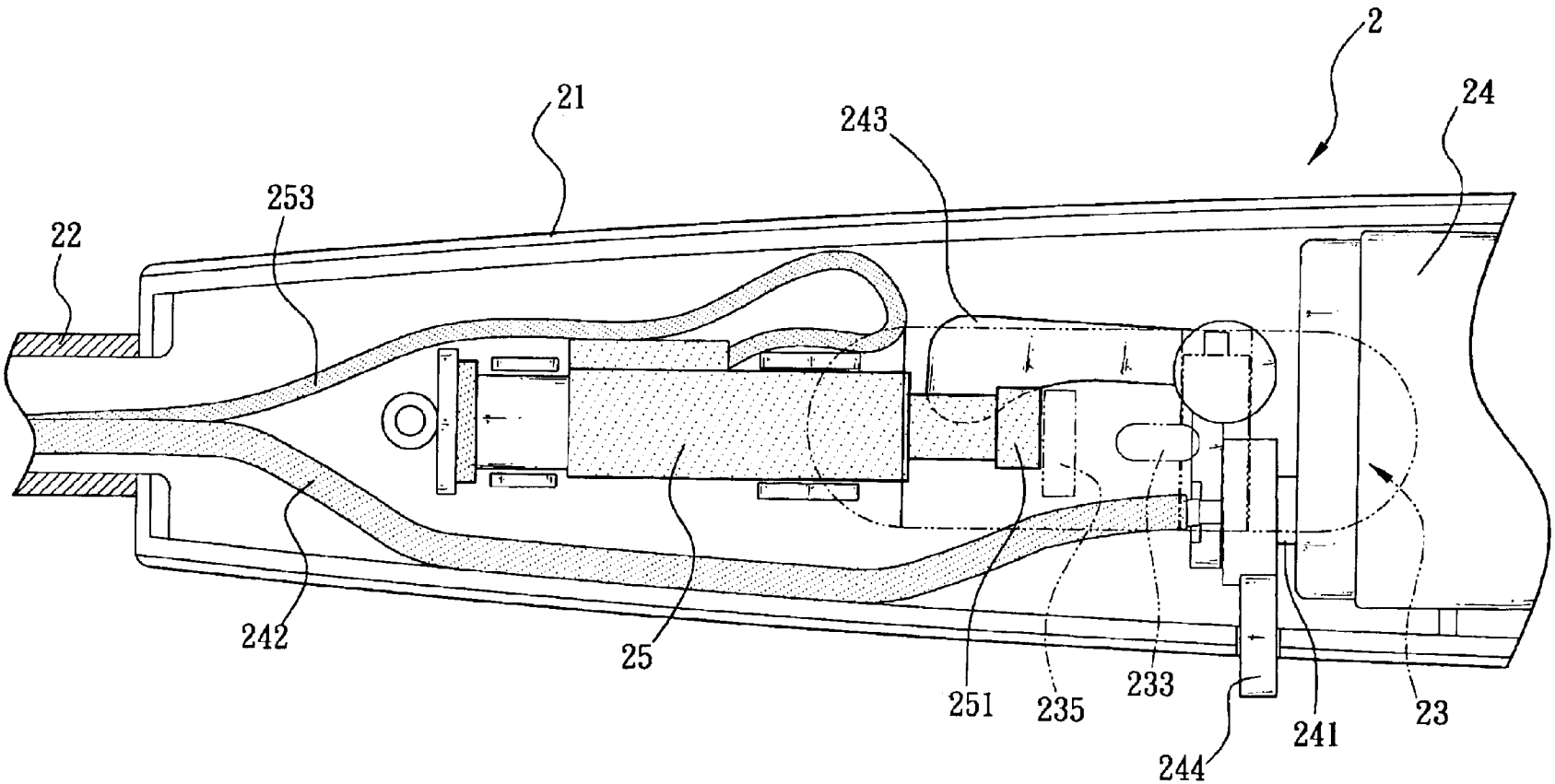
FIG. 3 is a cross-sectional view of the safety switch of the present invention.

Referring to FIG. 3, the present invention is a ignition (2) and is composed of a hollow body (21) graspable by users, a tube (22) stretches out from one side of the hollow body (21), an ignition area (not shown in FIG) in at the end of the tube (22), an open (not shown in FIG) is on the top center of the hollow body (21), a safety switch (23) is installed freely on the open, two slide slots (not shown in FIG) are on both side of the bottom of the safety switch (23), the safety switch (23) with two slide slots are installed on the brim of the open of the hollow body (21), the safety switch (23) can be moved forward or backward inside the hollow body (21).

Figure 4:
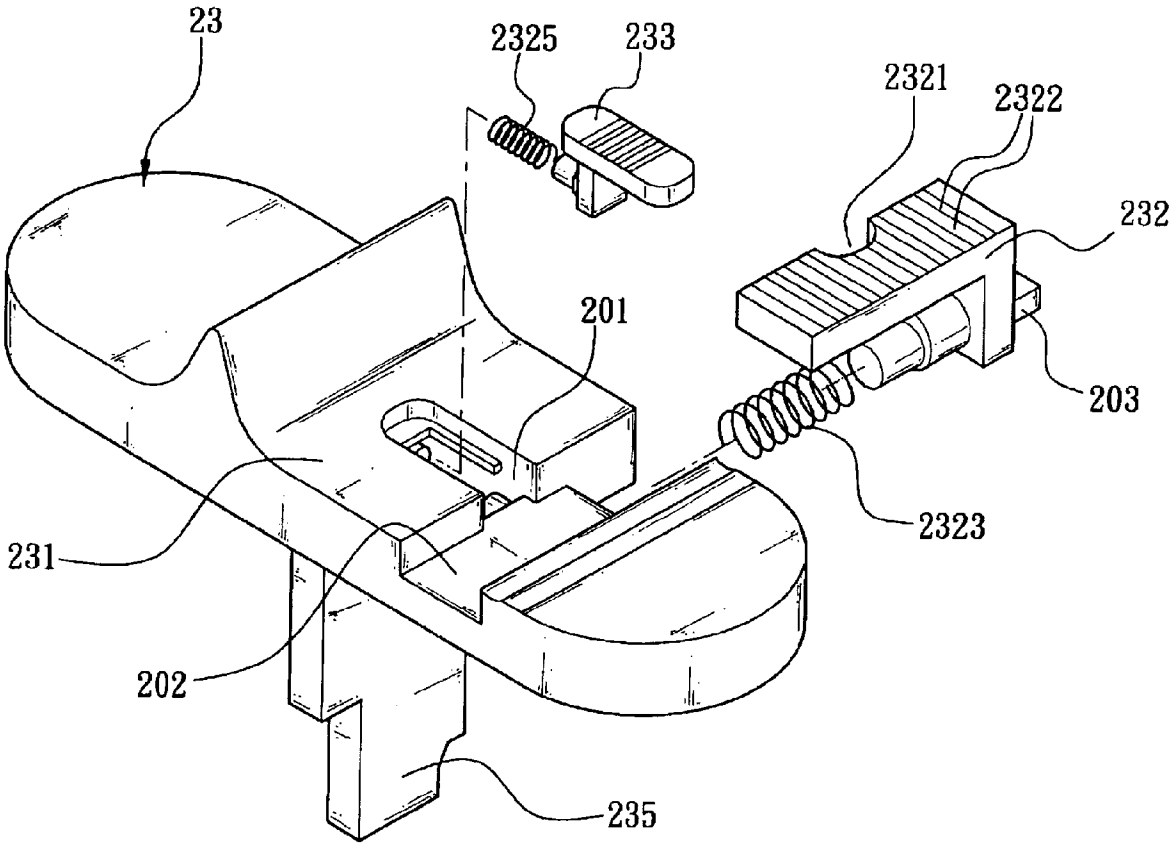
FIG. 4 is an assembly view of the safety switch of present invention.
Figure 5:
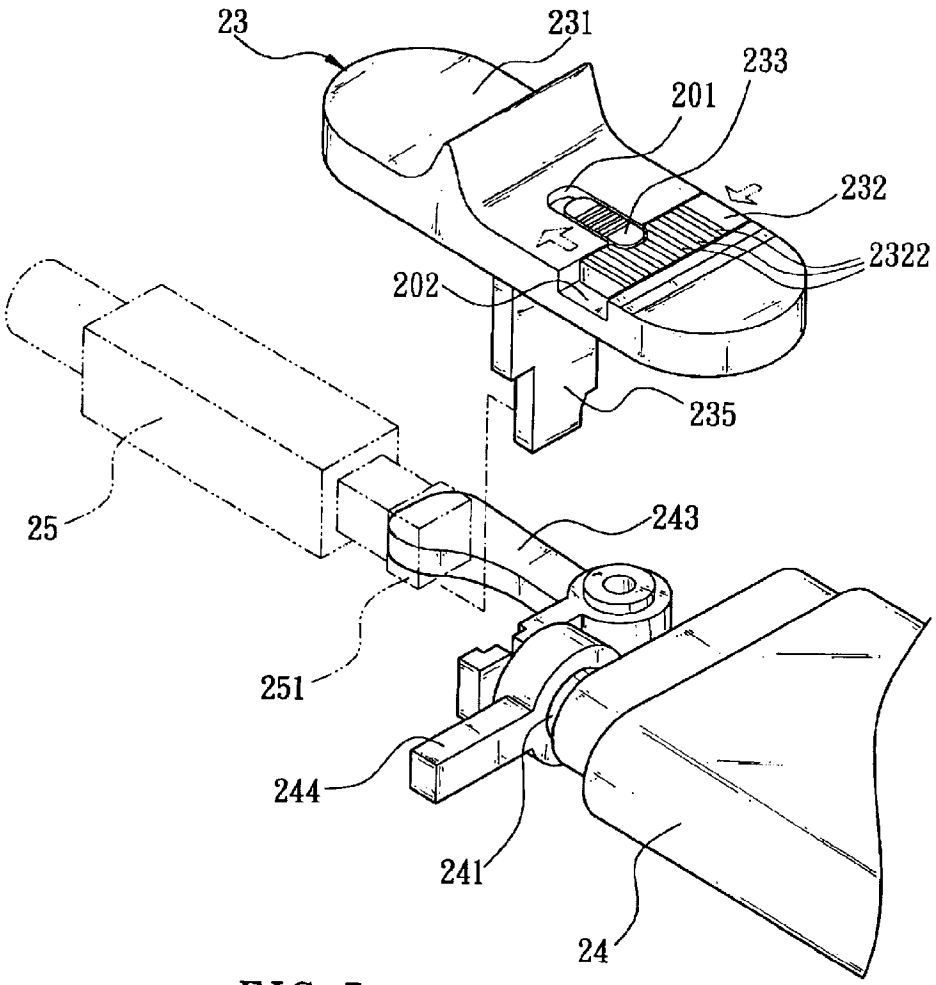
FIG. 5 is an assembly view of the present invention.
Figure 6:
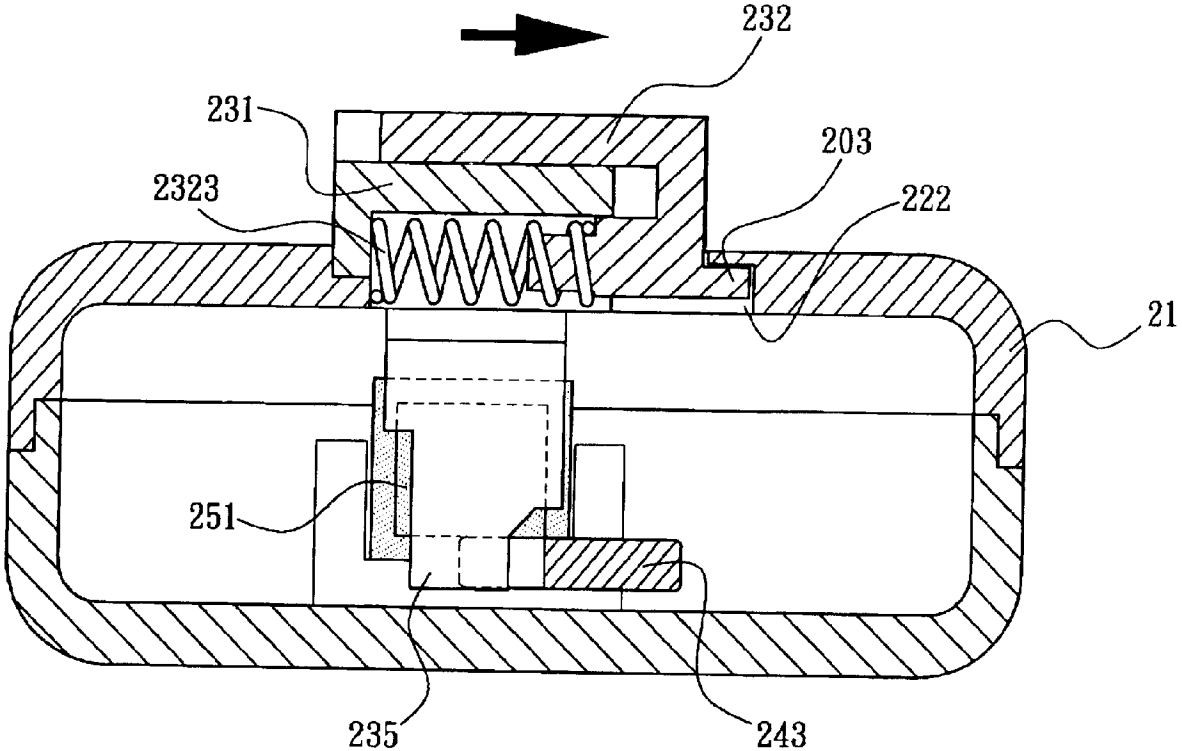
FIG. 6 is a cross-sectional view of the hollow body of the present invention.
Figure 7:
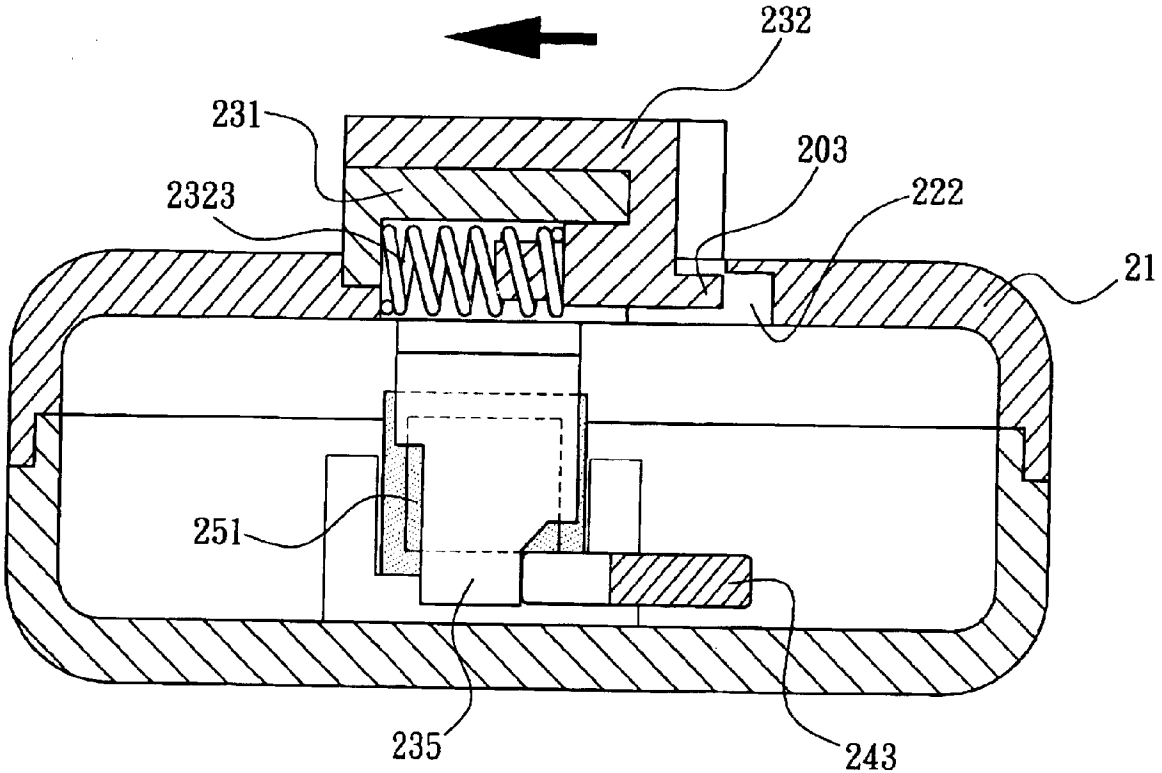
FIG. 7 is another cross-sectional view of the hollow body of the present invention.

Referring to FIG. 3 and FIG. 4, a pedestal (231) is on the safety switch (23), a brake bar (232) is inside of the pedestal (231), the brake bar (232) is inside a slide slot (202) of the pedestal (231) to move right or left in the slide slot (202); the top of the brake bar (232) exposes to the pedestal (231), the brake bar bottom (203) stretches horizontally to an indentation slot (222) of the hollow body (21) (as shown in FIG. 6 and FIG. 7) to have the indentation slot (222) block the brake bar (232), so the safety switch (23) can not be moved forward. A brake component (233) is installed freely in an open slot (201) of the pedestal (231) near the brake bar (232), the brake component (233) can move inside the open slot (201) forward or backward; one end of the brake component (233) wedges to one of the open slot (2321) of the brake bar (232), when start fire, referring to FIG. 4 and FIG. 5, users have to push the brake component (233) away from the corresponding the location of the open slot (2321), then push the brake bar (232) away from the location of the corresponding indentation slot (222), the safety switch (23) then can be pushed forward for fire, the mechanism can prevent the safety switch (23) from accidentally pushing forward.

Referring to FIG. 3 and FIG. 5, a gas tank (24) and an electronic pilot (25) are near the hollow body (21). A gas outlet (241) is on top of the gas tank (24), a soft tube (242) connects to the gas outlet (241), one side of the soft tube (242) connects to the gas outlet (241), the other side of the soft tube (242) stretches out to the top of the tube (22) and connects to the ignition area of the ignition (2), a pulling board (243) is on the proper location of the gas outlet (241) of the gas tank (24), a starter (251) is on the bottom of the electronic pilot (25), the end of the starter (251) stretches down and connects to the curve free end of the pulling board (243), the electronic pilot (25) connects to the ignition (2) through a wire (253) and connects to the inner brim of the tube (22) with another wire (not shown in FIG) to form a ignition loop.

Referring to FIG. 3, FIG. 4 and FIG. 5, a starting board (235) is beneath the safety switch (23), the end of the starting board (235) stretches down and connects to the free end of the pulling board (243), when the safety switch (23) is pushed forward, the starting board (235) can push the starter (251) and the curve free end of the pulling board (243) to have the pulling board (243) pull off the gas outlet (241) of the gas tank (24), so the gas inside the gas tank (24) can flow through the soft tube (242) to the ignition area of the ignition (2), at the same time to have the electronic pilot (25) generate a pilot fire on the ignition area of the ignition (2) and make fire by the gas of the gas tank (24) and the pilot fire generated by the electronic pilot (25).

On above application and referring to FIG. 4 and FIG. 5, a plurality number of anti-slippery stripe (2322) are on the top of the brake bar (232), when users push the brake bar (232), the anti-slippery stripe (2322) can increase the friction, users can push the brake bar (232) more smoothly.

Referring to FIG. 3 and FIG. 5, a regulator is connected between the gas tank (24) and the gas outlet (241), an adjustable rod (244) stretches out from the regulator, the other end of the adjustable rod (244) exposes to the hollow body (21) of the ignition (2), users can adjust the quantity of gas flow through the adjustable rod (244).

Referring to FIG. 3, an air inflation valve (not shown in FIG.) locates on one side of the gas outlet (241) that is farther from of the gas tank (24), an open hole (not shown in FIG.) corresponding to the position of the air inflation valve is on the hollow body (21), the air outlet valve of the air inflation tank (not shown in FIG.) connects to the air inflation valve to have the gas fills into the gas tank (24); when the gas is out, the gas tank (24) does not have to be thrown away to cause waste.

Referring to FIG. 3 and FIG. 4, an elastic component (2323), a spring for example, is installed between the brake bar (232) and the pedestal (231); the elastic component (2323) can push back the brake bar (232) to the original position.

Referring to FIG. 3 and FIG. 4, another elastic part (2325), a spring for example, is installed between the brake component (233) and the pedestal (231); the elastic part (2325) can push back the brake component (233) to the original position.

While a preferred embodiment of the invention has been shown and described in detail, it will be readily understood and appreciated that numerous omissions, changes and additions may be made without departing from the spirit and scope of the invention.

What is claimed is:

1. An electronic pilot ignition with safety switch comprising:

a hollow body with a tube stretches out from one side of said hollow body, an ignition area located on the end of said tube;

a safety switch installed freely on the open of said hollow body, said safety switch with two slide slots on both side of the bottom are installed on the brim of the open of said hollow body to be moved forward or backward inside said hollow body, a pedestal is on said safety switch;

a brake bar installed of said pedestal, the top of said brake bar exposes to said pedestal, the brake bar bottom stretches horizontally to an indentation slot of said hollow body to have said indentation slot block said brake bar, said safety switch can not be moved forward;

a brake component installed freely in an open slot of said pedestal near said brake bar, one end of said brake component wedges to one of the open slot of said brake bar;

a gas tank located inside said hollow body, a gas outlet installed on top of said gas tank, a soft tube connects to said gas outlet, one side of said soft tube connects to said gas outlet, the other side of said soft tube stretches out to the top of said tube and connects to said ignition area of the ignition, a pulling board is on the proper location of said gas outlet;

a electronic pilot located inside said hollow body, a starter installed on the bottom of said electronic pilot, the end of said starter stretches down and connects to the curve free end of said pulling board, said electronic pilot connects to the ignition through a wire and connects to the inner brim of said tube with another wire to form a ignition loop; and a starting board installed beneath said safety switch, the end of said starting board stretches down and connects to the free end of said pulling board.

2. The electronic pilot ignition with safety switch recited in claim 1, wherein a plurality numbers of anti-slippery stripes located on the top of said brake bar.

3. The electronic pilot ignition with safety switch recited in claim 1, wherein a regulator installed on the connection between said gas valve and said gas tank, an adjustable rod is on the regulator, said adjustable rod exposes from said hollow body that is farther from the other side of said gas tank, said adjustable rod adjusts the flow of gas from said gas tank.

4. The electronic pilot ignition with safety switch recited in claim 1, wherein an air inflation valve located on one side of said gas outlet that is farther from of said gas tank, an open hole corresponding to the position of said air inflation valve is on said hollow body, an air outlet valve of the air inflation tank connects to said air inflation valve to have the gas fills into said gas tank.

5. The electronic pilot ignition with safety switch recited in claim 1, wherein an elastic component installed between said brake bar and said pedestal, said elastic component pushes back said brake bar to the original position.

6. The electronic pilot ignition with safety switch recited in claim 1, wherein an elastic part installed between said brake component and said pedestal, said elastic part pushes back said brake component.

* * * * *